United States Patent [19]

Clark

[11] 4,066,229

[45] Jan. 3, 1978

[54] DEVICE FOR PREVENTING TRACTION POWER HARMONIC INTERFERENCE ON HIGH FREQUENCY TRACK CIRCUITS

[75] Inventor: Garry E. Clark, Alberta, Canada

[73] Assignee: General Signal Corporation, Rochester, N.Y.

[21] Appl. No.: 770,174

[22] Filed: Feb. 18, 1977

[51] Int. Cl.[2] ..... B61L 21/00

[52] U.S. Cl. ..... 246/34 CT; 178/69 B; 333/12

[58] Field of Search ..... 178/69 B; 180/98; 246/34 R, 34 CT, 40, 63 R, 63 C, 122 R, 167 R; 323/50, 53; 333/12; 336/73, 171, 181; 340/195, 196; 343/867

[56] References Cited

U.S. PATENT DOCUMENTS

| | | | |
|---|---|---|---|
| 2,159,927 | 5/1939 | Cannon | 178/69 B |
| 3,176,282 | 3/1965 | Rhoades | 323/53 X |
| 3,715,669 | 2/1973 | LaForest | 246/34 CT X |
| 3,932,713 | 1/1976 | Fleuchavs et al. | 178/69 B X |

*Primary Examiner*—Stephen G. Kunin

*Attorney, Agent, or Firm*—Milton E. Kleinman; John Ohlandt

[57] ABSTRACT

An overlay selective harmonic transducer device is installed on affected track circuits, that is, track circuits on which interference with normal functioning has occurred due to traction power harmonics.

4 Claims, 1 Drawing Figure

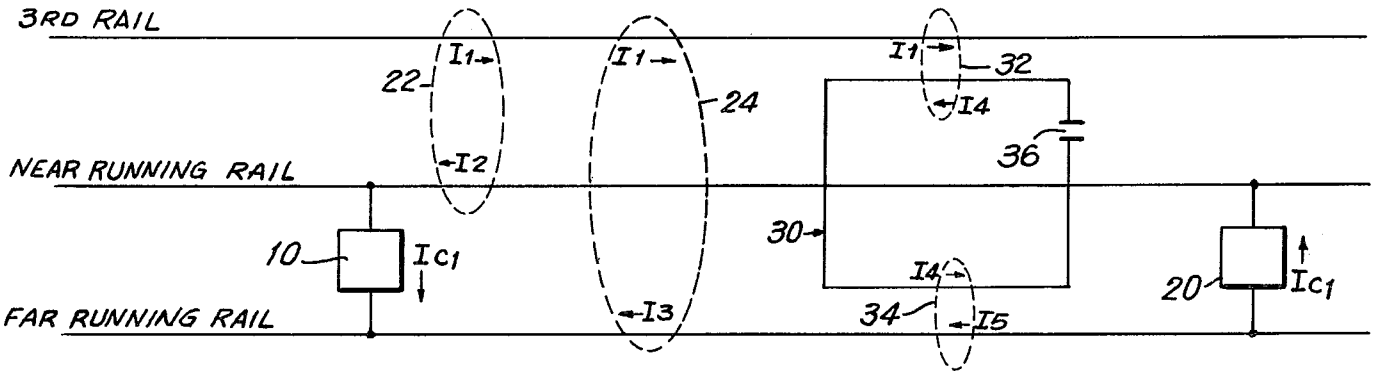
3RD RAIL
NEAR RUNNING RAIL
FAR RUNNING RAIL
10
20
22
24
30
32
34
36
I1
I2
I3
I4
I5
Ic1

DEVICE FOR PREVENTING TRACTION POWER HARMONIC INTERFERENCE ON HIGH FREQUENCY TRACK CIRCUITS

BACKGROUND, OBJECTS AND SUMMARY OF THE INVENTION

The present invention relates to a device for use on so-called high frequency track circuits, such circuits being extensively used to determine the presence of a railroad vehicle or the like within a section of track defined by the positioning of a transmitting unit and a receiving unit.

A great number and variety of track circuits have been developed over the past 30 years or so, and the principal purpose of such circuits is generally to detect the presence of a railroad vehicle effectively operating as a shunt across the rails, thereby to indicate the presence of such vehicle. The end to be realized is that the shunting caused by the presence of the vehicle will result in the production of block signals useful for indicating to other vehicles that a particular block or zone is occupied.

Some of the aforenoted track circuits are DC in nature and often involve insulated joints. One can have relatively long DC track circuits and even with a poorly shunting vehicle, a relay which normally is held up at one end by a power source feeding the track circuit from the other end, will be de-energized or drop away, thereby providing detection of such vehicle even under the most unfavorable conditions. However, with jointless track circuits, the track rail is continuous and termination of the track circuit is accomplished by means of a shunt across the rails at the extreme ends of the circuit.

Despite certain advantages to DC track circuits, the most common form of present day track circuit is one operating with AC. Using alternating current, however, introduces the factor of inductive rail impedance which increases as the frequency of the input current increases.

In order to provide complete background for the subject matter of the present invention, reference may be made to certain prior art control systems and associated track circuits in U.S. Pat. Nos. 1,852,571; 3,663,809; 3,670,161; 3,715,669.

In particular, the system described in U.S. Pat. No. 3,715,669 involves a receiver forming part of an overlay track circuit in which a frequency modulated signal having alternately occurring extreme side band components is communicated along a railroad right-of-way. Such system is subject to the influence of the presence of a railroad vehicle and the system comprises a tuner means responsive to the FM signals separating one side band component of the signal from the other, and polarizing means for generating distinctive signals of opposite polarity in response to the respective side band components. The receiver in the aforenoted system is coupled to rails by a directly connected series resonant circuit including a coil and a capacitor and a further coupling coil. Thus the receiver filters and amplifies a signal for transmission to the next stage of the system.

Whatever the particular components and features that may be utilized in a high frequency AC track circuit, the present invention is designed and constructed specifically to overcome a fundamental problem occurring in such context. More particularly, in the specific context of a pulse code modulated track circuit the invention is particularly advantageous in that it overcomes an infortuitous "filling in" by an undesired signal with reference to a generated pulse code pattern such that the track relay would be caused to drop even though a train is not on the predetermined section of track. This aspect will become clear as the description proceeds.

The particular problem arises due to the fact that harmonic frequencies result from the traction power used on the railroad right-of-way; thus, the traction power is frequently switched on and off in such a way that the harmonic frequencies which are generated are coupled from the third rail to the near running rail to a substantially higher degree than they are coupled from the third rail to the far running rail. The eventual result is that a circulating alternating current develops in the track circuit, recalling that the track circuit utilizes the same running rails. There is no problem with DC because the return thereof is split equally between the running rails.

Accordingly, it is a primary object of the present invention to overcome or prevent interference with the normal functioning of a pulse modulated or similar AC track circuit by reason of the adventitious coupling thereto of the harmonic frequencies of the traction power utilized for operating motors and the like. These harmonic frequencies in particular regard to pulse code modulated track circuits, function to fill in the gaps, so to speak, during the OFF periods of the normal pulse code signal and thus interfere with normal operation causing a remote track circuit to give an erroneous signal.

The above and other objects are achieved by a principal feature of the present invention which comprises a transducer coil arrangement which is so installed in respect to the affected track circuit that a cancellation effect is achieved in regard to the circulating current caused by the aforesaid undesired coupling of the traction power harmonic frequencies. Thus, the circulating current is effectively no longer present and its effects are obviated.

In accordance with such feature, a coil made up of several turns of wire is provided and is run close and parallel to the third rail and also close and parallel to the far running rail. By selecting a capacitor of the appropriate size and by placing the capacitor in circuit with the coil, the coil can be tuned to the harmonic frequency that is the source of the coupling problem. Moreover, by the use of a suitable jumper the particular number of turns required to offset the effect of the circulating current could be adjusted in the field. In other words, the particular magnitude or value of induced voltage can be selected by such appropriate selection of the number of turns.

In accordance with the coil arrangement of the present invention, the harmonic noise frequency generated in the third rail is magnetically coupled to the cancellation coil, that is, the transducer coil that is specially arranged as aforenoted. In turn, because of this particular arrangement, the coil also magnetically couples the same frequency into the far running rail. Consequently, the coupled signal is completely out of phase with the coupled signal present in the nearest rail. As an ultimate result the signal coupled from the cancellation coil cancels the effect of the circulating current which is causing the problem. It virtually completely reduces the in band noise seen by the receiver.

Other and further objects, advantages and features of the present invention will be understood by reference to the following specification in conjunction with the annexed drawing, wherein like parts have been give like numbers.

BRIEF DESCRIPTION OF THE DRAWING

The FIGURE is a diagrammatic illustration of one embodiment of the invention applied between several tuned circuits forming part of the conventional AC track circuit.

DESCRIPTION OF PREFERRED EMBODIMENT

In the preferred embodiment of the invention illustrated, there is shown diagrammatically a trackway comprising a third rail as indicated and a pair of running rails denominated "near" running rail and "far" running rail, this reference being with respect to the third rail. As will be understood in a system in which power is supplied to the motors and like equipment in the train by means of the third rail, the return involves a splitting of the return current between the two running rails.

On the other hand, in respect to a track circuit such as one exemplified by U.S. Pat. No. 3,715,669, the receiver filter and amplifier are connected to the two running rails. In other words, these two running rails form part of the transmission path for the AC track circuit. In order to simplify the presentation of the subject matter of the present invention, only exemplary tuned circuits forming part of the receiver equipment of a particular AC track circuit are shown and are designated by the numerals 10 and 20 in the figure. Next to these individual boxes 10 and 20 the undesired circulating current $IC_1$ is shown. In the case of the tuned circuit 10 on the left, $IC_1$ is shown as flowing downward, whereas on the right it is shown flowing upward. This is for the reason that a complete loop between the two tuned circuits 10 and 20 is under consideration. Normally these two tuned circuits 10 and 20 would be spaced anywhere from 50 to 1000 feet depending on the particular track circuit arrangement.

What gives rise to the problem of the circulating current $IC_1$ is that, for example, whenever the traction power is switched on and off, it gives rise to an harmonic frequency or frequencies, with the result that currents are magnetically induced from the third rail into both the near running rail and the far runnig rail. Thus, with the understanding that the arrows indicated for the various currents to be discussed indicate instantaneous direction, it will be appreciated that for a given time-varying current $I_1$ in the third rail, there will be induced in the near running rail, because of the coupling loop 22 which is dependent upon the strength of $I_1$ and the distance between the third rail and the near running rail, a current $I_2$ in opposite phase to the current $I_1$. Likewise, referring to the magnetic coupling loop indicated by the symbol 24, the same current $I_1$ will also induce a current $I_3$ in the far running rail, the value of which is dependent on the distance between the third rail and the far running rail.

It is manifest that the current $I_3$ induced in the far running rail will be substantially less than the current $I_2$ in the near running rail and that a difference current, namely, the circulating current $IC_1$, and assuming that the frequency thereof is of an appropriate frequency, will be accepted and passed through the tuned circuits 10 and 20.

As explained previously, the acceptance of such an undesired signal, particularly in the context of a pulse code modulation scheme, means that the timing of the noise current generation or induction may be such as to interfere with the regular pulse code pattern and to give a false indication to the receiver, whereby the track relay drops away and gives an indication that a train is on a particular section of track even though that is not the case.

The present invention overcomes the spurious or false indication by compensating for and effectively canceling out the circulating current $IC_1$. In accordance with the invention, a coil arrangement 30 is provided which is seen between the two tuned circuits 10 and 20. This coil arrangement can be located suitably anywhere between such circuits. Coupling is provided to both the third rail as indicated by the loop 32, in dotted lines, and also to the far running rail by the loop 34.

In order to counter and effectively cancel the particular harmonic frequency or frequencies which give rise to the problem of interference with the normal operation of the AC track circuit, a capacitor 36 is included in the loop 30. It will be apparent, of course, that one selects an appropriate capacitor such that the loop circuit may be tuned to the particularly troublesome harmonic frequency or frequencies.

It will be noted that the loop 30 is ineffective to produce induction of any current in the near running rail. Thus the loop is extended in normal fashion, that is, in substantially perpendicular relationship to the near running rail, and the result is of course that no coupling is enabled between the rail and the loop 30. Accordingly, with the third rail noise current $I_1$ being generated, there is induced in the coil 30 a current $I_4$, which is out of phase with $I_1$. This induced current further produces induction of a current $I_5$ in the far running rail because of the coupling 34. This induced current $I_5$ is judiciously selected to have a value substantially equal to the net or circulating current $IC_1$, which is the difference between $I_2$ and $I_3$. Accordingly, an altered circulating current $IC_2$ results which is the algebraic difference between $(I_2 - I_3)$ and $I_5$, having a value of approximately zero.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. In a system for use along a railroad trackway, involving an AC track circuit including a plurality of tuned circuits connected to near and far running rails for indicating the presence of a vehicle, the improvement which comprises:

an arrangement including a cancellation coil for canceling the circulating current which flows in the loop defined by said near and far running rails and is normally accepted by said tuned circuits, said circulating current being due to the differential induction of noise currents from said third rail to said far running rail and to said near running rail, respectively, said cancellation coil including means for inducing corresponding noise current from said third rail into said cancellation coil and from said cancellation coil into said far running rail, and means for avoiding the inducing of the noise current from said coil into said near running rail, thereby to effectively cancel said circulating current.

2. Apparatus as defined in claim 1, in which said cancellation coil comprises several turns of wire running near and parallel both to said third rail and to the far running rail.

3. Apparatus as defined in claim 1, in which said means for avoiding comprises a portion of said cancellation coil which extends in perpendicular relationship to said near running rail.

4. Apparatus as defined in claim 1, further including a capacitor connected in a loop defined by said cancellation coil arrangement, whereby a cancellation signal having a frequency corresponding to the frequency of said noise current can be produced.

* * * * *